United States Patent [19]

Iikawa

[11] Patent Number: 5,076,190

[45] Date of Patent: Dec. 31, 1991

[54] SMALL WATERCRAFT

[75] Inventor: Yukio Iikawa, Kakogawa, Japan

[73] Assignee: Kawasaki Jukogyo Kabushiki Kaisha, Kobe, Japan

[21] Appl. No.: 604,352

[22] Filed: Oct. 29, 1990

Related U.S. Application Data

[63] Continuation of Ser. No. 382,543, Jul. 19, 1989, abandoned.

[30] Foreign Application Priority Data

Jul. 19, 1988 [JP] Japan ..... 63-95498[U]

[51] Int. Cl.[5] ..... B63B 35/00

[52] U.S. Cl. ..... 114/270; 114/121

[58] Field of Search ..... 440/88, 89, 43; 114/270, 357, 121

[56] References Cited

U.S. PATENT DOCUMENTS 3,426,724 2/1969 Jacobson ..... 114/270
3,552,349 1/1971 Snow ..... 114/270
4,768,983 9/1988 Smith ..... 114/270
4,781,141 11/1988 Webb et al. ..... 114/270

*Primary Examiner*—Jesus D. Sotelo
*Attorney, Agent, or Firm*—Marshall, O'Toole, Gerstein, Murray & Bicknell

[57] ABSTRACT

A watercraft has a center part of the aft deck protruding upwardly to form a saddle, and the top of the deck in front of and on both sides of said saddle is formed into a continuous U-shaped stepping surface so that the operator sitting on the saddle can operate the craft with his/her legs stretched forward. Preferably, the lower part of the saddle is formed into an engine compartment so as to collectively arrange an engine, an oil tank, a muffler and other auxiliary parts inside the engine compartment. The fore portion of the hull may be formed into an equipment compartment and a fuel tank compartment, and a hatch cover may be installed over the opening of the equipment compartment so that the opening can be opened and closed by pivoting the cover.

1 Claim, 2 Drawing Sheets

SMALL WATERCRAFT

This application is a continuation of application Ser. No. 07/382,543, filed July 19, 1989, now abandoned.

FIELD AND BACKGROUND OF THE INVENTION

This invention relates to a small recreational watercraft equipped with a water jet propulsion device in the aft portion of the bottom of the hull and which is designed to be maneuvered by an operator mounted on a deck on the aft portion of the hull and holding a steering bar installed in the fore portion of the hull; and more specifically it relates to the shape of the hull.

This type of watercraft is generally used close to shore in the ocean or on a lake for leisure and sports purposes, and is designed to permit the operator to enjoy relatively rough operation such as quick starts and sharp turns while maintaining the balance of the craft by shifting the weight of the operator's body.

In conventional small watercraft, the aft portion of the deck of the hull where the operator mounts the craft is formed in the shape of a platform or a step on almost all of its surface so that the operator can operate the craft while standing (see U.S. Pat. No. 4,768,453, for example), or the center portion of the aft deck protrudes slightly upwardly to form a saddle-like seat connected to the engine compartment wall in front so that the operator may sit astride the seat (see, for example, Japanese Patent Provisional Publication No. 61-232986).

In the conventional watercraft as described above with a seat on the aft deck, since the operator sits astride the seat, leg space is limited. Moreover, when two people are on board, it is difficult to switch positions while afloat.

Furthermore, in this conventional watercraft, since the seat is connected to the engine compartment toward the front, if the operator tries to board the craft near the center (measured in the longitudinal direction), the seat impedes such boarding. Therefore, both the operator and any passenger in many cases must board by climbing over the deck from the aft end of the hull, but in the conventional watercraft in which the engine and the auxiliary parts are installed in the fore portion of the hull, the fore portion of the hull is submerged below the water while the aft end of the hull is kept afloat well above the water line until the operator and passenger get on board, thereby making it difficult to get on board even from the aft end.

The primary object of this invention is to provide a step-through type watercraft which the operator can operate while in a position much like what when riding a motor scooter, with less fatigue even after many hours of operation, in addition to allowing boarding near the center of the watercraft, offering optimal riding comfort and higher performance regarding sharp turns and quick starts than the conventional watercraft, thereby making it possible to fully enjoy rapid travel on the water.

SUMMARY OF THE INVENTION

A watercraft according to this invention has a center part of the aft deck protruding upwardly to form a saddle, and the top of the deck in front of and on both sides of said saddle is formed into a continuous stepping surface so that the operator sitting on said saddle can operate the craft with his/her legs stretched forward.

Preferably, the lower part of the saddle is formed into an engine compartment so as to collectively arrange an engine, an oil tank, a muffler and other auxiliary parts inside the engine compartment.

The fore portion of the hull may be formed into an equipment compartment and a fuel tank compartment, and a hatch cover may be installed over the opening of the equipment compartment so that the opening can be opened and closed by pivoting the cover.

The watercraft according to this invention is advantageous in that the operator sitting on the saddle can stretch forwardly or freely move his/her legs in order to operate the craft in the most comfortable position. Riding comfort is excellent and the craft can be operated while engaging in such motions as shifting the center of gravity by changing the operating position while making turns or bending forward in order to reduce wind resistance while moving at high speeds. As it is possible to move on to the left or right step by passing through the step in front of the seat, it is possible to change operators while afloat. When boarding at the center of the craft, the space in front of the seat makes boarding easier.

Also, if the lower part of the saddle is formed into an engine compartment, with the engine, oil tank, muffler and other auxiliary parts placed in the compartment, the trim of the craft hardly differs between when the operator, etc. are on board and when nobody is on board.

By forming the fore portion of the hull into an equipment compartment and a fuel tank compartment, and installing a hatch cover over the opening of the equipment compartment that can be opened and closed by pivoting the cover, the hatch cover can be opened to stow equipment and to check the fuel level in the fuel tank. Also, by opening the hatch cover, the fuel tank can be installed or the steering mechanism can be adjusted or repaired if necessary.

BRIEF DESCRIPTION OF THE DRAWINGS

The invention will be better understood from the following description taken in conjunction with the accompanying drawings in which.

DETAILED DESCRIPTION OF THE DRAWINGS

Figure 3:
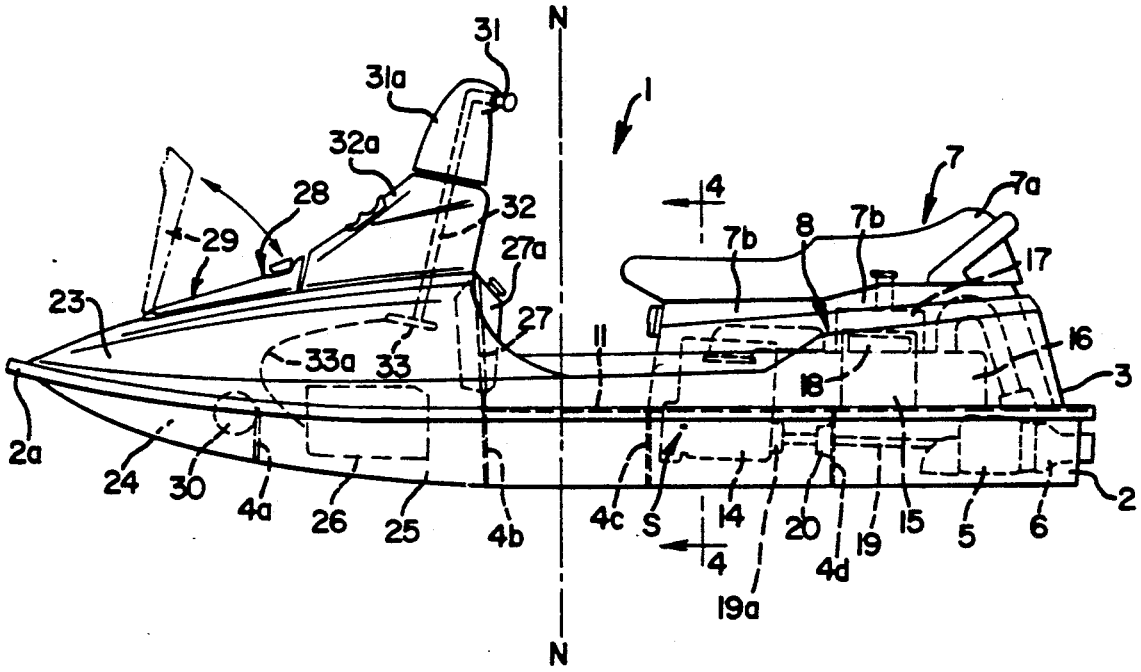
FIG. 3 is a side view of the craft with some internal parts shown in dashed lines.

The watercraft 1 is relatively broad and, as shown in FIG. 3, the center of buoyancy S is slightly aft of or behind the structural center N measured in the longitudinal direction with nobody aboard and when the craft is stationary on the surface of the water. The craft 1 includes a lower hull 2 and an upper deck 3 which are solidly joined together along a peripheral flange 2*a*.

As shown in FIG. 3, the inside of the hull 2 is divided by multiple bulkheads 4*a*, 4*b*, 4*c*, 4*d* and 4*e* which extend in the transverse and longitudinal directions. The aft portion of the hull 2 is provided with a water jet propulsion device 5, at the aft end of which is a steering nozzle 6.

Figure 1:
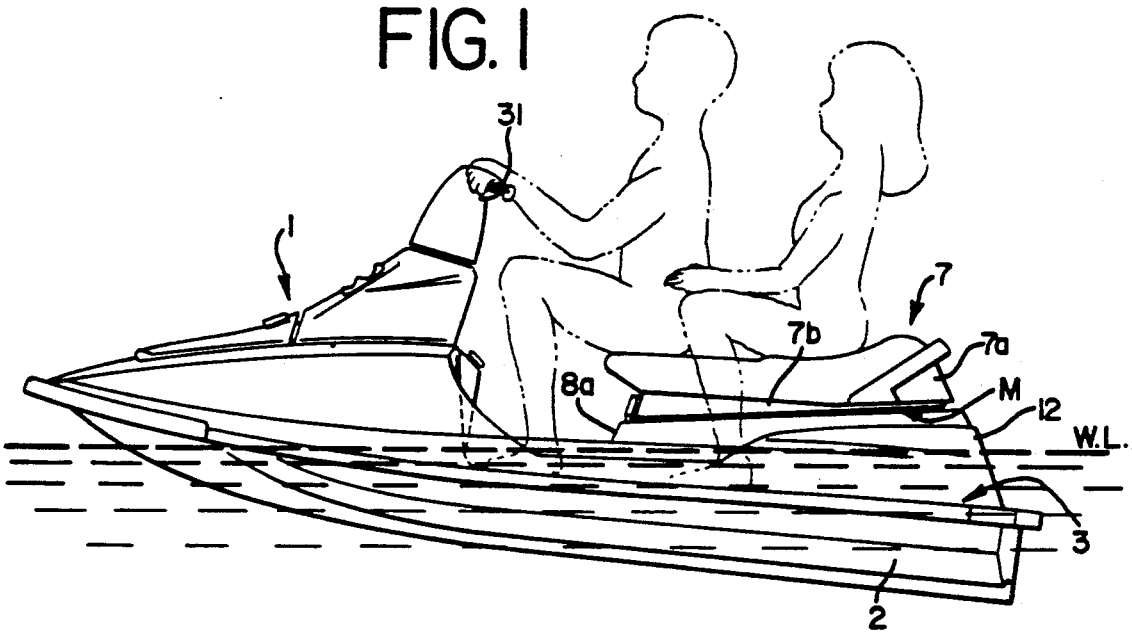
FIG. 1 is a side view of a small watercraft according to this invention.
Figure 4:
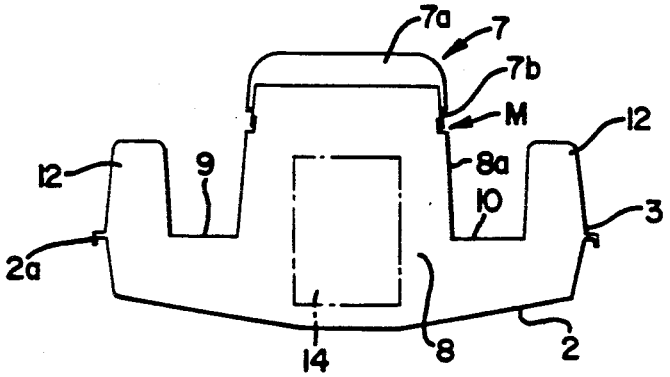
FIG. 4 is a simplified cross sectional view taken on the line 4—4 in FIG. 3.

As shown in FIG. 4, the center of the rear portion of the deck 3 includes a wall 8*a* which protrudes upwardly and is formed into a saddle 7. As shown in FIGS. 3 and 4, below this saddle 7 the wall 8*a* forms an engine compartment 8, the top of which is open. This top opening is provided with a removable rear hood 7*b* that is open on its bottom side and is equipped with a tandem seat or cushion 7*a* on its upper side. Although not shown, a seal packing is secured around either the upper edge of the surrounding wall 8*a* of the engine compartment 8 or the lower edge of the rear hood 7*b* in order to prevent water from entering the compartment 8. As shown in FIG. 1, the joint M between the upper edge of the surrounding wall 8*a* and the lower edge of the rear hood 7*b* is located above the draft or water line W.L. of the hull when the craft is stationary and is occupied by the rated number (two in this instance) of persons, so that the joint M is not submerged in the water in the normal state (stationary or moving).

Figure 2:
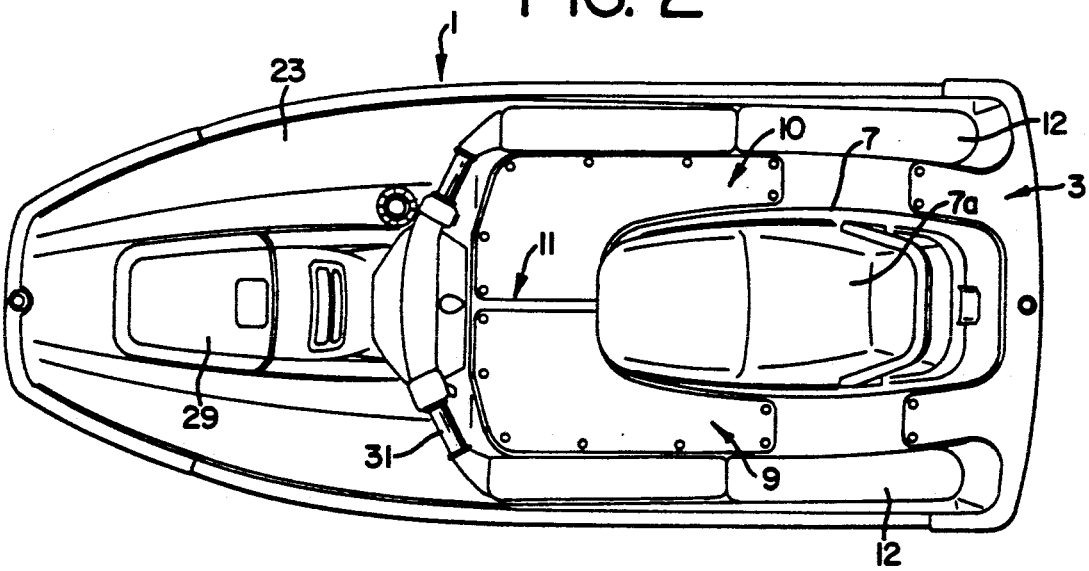
FIG. 2 is a plan view of the craft.

As shown in FIGS. 1, 2 and 4, and as a primary feature of this invention, steps 9, 10, and 11, which form a continuous U-shape when viewed from above, for resting the feet and legs are formed on the deck 3 in front of and on both sides of the saddle seat 7. Therefore, the operator can maneuver the watercraft 1 by grasping a control handle bar 31, which will be described later, while sitting on the saddle seat 7 and placing his/her legs on the front step 11 in front of the seat as shown in FIG. 1.

As shown in FIG. 4, each longitudinally extending side of the deck 3 is formed into a fin 12 which protrudes upwardly outside the left step 9 and the right step 10.

As shown in FIG. 3, an engine 14 for driving the water jet propulsion device 5 is mounted in the fore portion of the engine compartment 8 formed by the walls 8*a*. The engine 14 is mounted roughly at the center of buoyancy S of the watercraft 1 when stationary on the water with nobody aboard. In other words, by placing the engine 14, which is the heaviest unit on board, close to the center of buoyancy S in the fore part inside the engine compartment 8, balance will be achieved by the watercraft 1 itself without the aid of an operator. The engine 14 and the center S are substantially on the longitudinal centerline of the craft. In the engine compartment 8, a water muffler 15 (FIG. 3) and a battery 16 are placed side by side just behind the engine 14, and an oil tank 17 and a box 18 containing electrical parts (not shown) for the engine are mounted on the water muffler 15. The engine 14 and the impellers (not shown) of the water jet propulsion device 5 are connected by a drive shaft 19 through a coupling 19*a*. The drive shaft 19 is journalled by a bearing 20 mounted on the most rearward bulkhead 4*d*.

The water muffler 15 is a type that is publicly known and generally used in this type of watercraft. It is designed so that the cooling water of the engine 14 is partially discharged into the exhaust gas channel and the exhaust gas accompanied by the cooling water passes through the muffler 15. Therefore, the temperature of the water muffler 15 when the engine 14 is running does not rise so high as that of usual mufflers. This makes it possible to mount the oil tank 17 and the electrical parts box 18 on the muffler 15.

In FIG. 3, in the fore portion from the longitudinal center N of the watercraft 1, a front hood 23 is solidly joined to and covers the upper fore portion of the hull 2, inside which are formed an equipment compartment 24 and a fuel tank compartment 25 behind it. The compartments 24 and 25 are separated in the lower portion by the most forward cross bulkhead 4*a*. A fuel tank 26 is placed in the compartment 25, the rear end of which is blocked by the bulkhead 4*b* and a vertical bulkhead 27 which extends upwardly from the bulkhead 4*b*. A receptacle 27*a* with a lid is provided in the central portion of the bulkhead 27 to store various things. The front hood 23 above the equipment compartment 24 has an opening 28 formed therein. As shown in FIG. 3, one end of a hatch cover 29 is pivotally attached to the front end of the opening 28, and the cover 29 can be opened upwardly at the front of the watercraft 1. With the hatch cover 29 opened, the amount of fuel remaining in the fuel tank 26 can be confirmed from the opening 28. A fire extinguisher 30 is preferably also installed in the equipment compartment 24.

The two fins 12 at the longitudinally extending sides of the deck extend along the outsides of the steps 9 and 10 as previously stated and as best shown in FIG. 4. As shown in FIGS. 1, 2 and 3, the two fins 12 extend longitudinally from the aft end of the hull, upwardly along the sides of the saddle seat 7 and the steps 9 and 10, and along the sides of the front step 11. At their foreward ends, the fins merge with the front hood 23.

As best shown in FIG. 3, a generally vertical steering shaft 32 is journalled in the middle of the rear end portion of the upper wall of the front hood 23, and a bar handle 31 is fixed to the upper end of the steering shaft 32. When the bar handle 31 is turned by the operator, the steering nozzle 6 connected to an operating member 33 at the lower end of the steering shaft 32 through a push cable 33*a* is swung horizontally to steer the watercraft 1. Foaming synthetic resin 31*a*, 32*a* is placed around the bar handle 31 and the steering shaft 32 so as to increase buoyancy. As the assembly or the repair of the steering shaft 32, push-pull cable 33*a*, etc. can be carried out through the opening 28 when the hatch cover 29 is opened, work efficiency is optimized.

In use, even before the operator and the passenger board the craft, it stays afloat in the water in almost horizontal posture on the surface of the water as shown in FIG. 1, because the engine 14 and the auxiliary parts 15–18 are arranged near the center of buoyancy S as shown in FIG. 3. Therefore, the operator et al. can board the deck 3 either from the aft end or near the center of the watercraft 1. Even when the operator et al. have boarded the watercraft 1 and are seated on the seat 7, the change of trim (posture) is as small as the extent to which the draft line W.L. of the watercraft 1 rises slightly, as shown in FIG. 1. In this state, the operator revs up the engine 14 (FIG. 3) to move the watercraft 1, while steering by holding the bar handle 31 in front of the seat 7 with both hands and moving the steering nozzle (FIG. 3) to the right or left. When in motion, the front end of the watercraft 1 is lifted; the degree of this lift increases as the speed rises, but any change in trim is smaller than with conventional watercraft of this type. Although, as shown in FIG. 3, the fuel tank 26 is placed slightly ahead of the longitudinal center N of the watercraft 1, hardly any change occurs in the trim of the watercraft 1 even if the fuel level in the tank 26 varies, because the engine 14 and the auxiliary parts 15–18 are collectively arranged near the center of buoyancy S as described above.

This invention may apply to a one-seater small watercraft as well.

A watercraft in accordance with this invention has numerous advantages. The operator can operate the watercraft while in a comfortable posture similar to that when riding a motor scooter. Because the operator can freely move his/her legs while seated in the seat, the center of gravity may be shifted by changing one's posture when making turns, etc. Moreover, it features higher performance retarding sharp turns and quick starts than conventional small watercraft because of the trim of the craft, allowing one to enjoy to the fullest the experience of moving on the water. When boarding from near the center of the watercraft, since there is a space in front of the seat, boarding is easy. Furthermore, as it is possible to move on to the steps from both the right and left sides through the space in front of the seat, the operator and a passenger may easily exchange seats even when the watercraft is stationary on the water.

In addition, the variation in trim between when the operator et al. are on board and when not is reduced by installing the engine, fuel tank, muffler and other auxiliary parts inside the engine compartment, which is formed beneath the seat, making the craft easy to board. The short distance between the engine and the water jet propulsion device makes it possible to reduce the length of the power train, especially the drive shaft, and simplify the hull structure around it. Also, because the engine is located near the center of buoyancy of the watercraft, the moment of inertia is so small that the watercraft is subject to less rolling and pitching even in rough waves.

Still further, the hatch cover can be opened to store equipment and, at the same time, check the amount of fuel left in the fuel tank. As this also facilitates the adjustment or repair of the steering shaft, etc., it improves work efficiency.

What is claimed is:

1. A watercraft comprising a hull and a deck, said hull having a fore portion and an aft portion, and said deck having a center and two longitudinally extending sides, said deck being on said aft portion of said hull, a steering bar installed in said fore portion of the hull, water jet propulsion device in said aft portionn of the bottom of said hull and adapted to be maneuvered by an operator on said deck and holding said steering bar, said center of said deck protruding upwardly so as to form a saddle having a front and two sides, a continuous U-shaped step being formed on said deck in front of and on both sides of said saddle, and two upwardly extending fins formed on said deck on the outside of said two longitudinally extending sides, said fins extending from said aft portion of said hull, said saddle being formed into an engine compartment, and an engine, an oil tank, a muffler and other auxiliary parts collectively arranged in said engine compartment, the forward portion of said hull being formed into an equipment compartment and a fuel tank compartment, an opening being provided at the top of said equipment compartment, and an openable hatch cover being mounted to said opening so as to be opened and closed by pivoting.

* * * * *